US005154131A

United States Patent [19]

Hall

[11] Patent Number: 5,154,131

[45] Date of Patent: Oct. 13, 1992

[54] ANCHOR

[76] Inventor: Pearly T. Hall, Rte. 2, Clinton, Mo. 64735

[21] Appl. No.: 675,650

[22] Filed: Mar. 27, 1991

[51] Int. Cl.[5] ..... B63B 21/00; B63B 21/24

[52] U.S. Cl. ..... 114/230; 114/294; 114/295; 114/297

[58] Field of Search ..... 114/294, 230, 293, 295, 114/297, 311, 210, 221 R

[56] References Cited

U.S. PATENT DOCUMENTS 4,281,612 8/1981 Watts ..... 114/230
4,741,283 5/1988 Conner ..... 114/230
4,834,437 5/1989 Howard ..... 114/230

*Primary Examiner*—Joseph F. Peters, Jr.
*Assistant Examiner*—Kenneth Lee
*Attorney, Agent, or Firm*—Heller & Kepler

[57] ABSTRACT

An anchor which attaches to a tree, stump or other stationary object for anchoring a buoyant vessel such as a boat, in a relatively stationary position. The anchor consisting of a clamping device, a pair of tongs attached to and extending from the clamping device, and an anchor line to attach the anchor to the boat. The tong engaging the tree or other stationary object to securely anchor and hold the boat in a relatively stationary position.

18 Claims, 4 Drawing Sheets

ANCHOR

BACKGROUND OF THE INVENTION

The present invention relates in general to an anchor and pertains, more particularly, to an anchor for use in anchoring a boat to a stationary object projecting above, at, or near the water line. The anchor of this invention is an improvement over conventional submerged anchors.

With the conventional anchor it is generally necessary to locate a boat or other buoyant vessel and then drop a weight attached to a line into the water. Ideally, the weight or anchor sinks until it reaches the bottom. The end of the anchor line attached to the boat holds the boat in position relative to the anchor's submerged position, taking into consideration any drift of the boat as the anchor line is drawn tight between the boat and the anchor and any movement of the anchor along the bottom if wind or current are strong enough.

Conventional anchors can be any number of shapes, sizes, weight and designs. Anchor design typically includes a projection or extension intended to lodge in the bottom and hold the boat securely against wind and current.

Any one who fishes is a common user of an anchor and also appreciates the problems that are associated with conventional anchors. The fisherman typically anchors himself at a particular location then desires to remain in a relatively stationary location until time to move on to another location.

Other conventional anchors are specifically designed to drag along the bottom. This provides a controlled movement of the boat. The rate of movement being determined by the bottom surface and the speed of the wind or current, and the particular design of the anchor.

Both of the foregoing anchor designs require some friction with the bottom. They are designed to engage the bottom in an effort to securely hold the boat in a stationary position. There are a number of designs for a bottom engaging device to actually dig into the bottom or less radical extensions or projections that allow the boat to slowly drift. Thus, as long as the wind and currents are not strong enough to overcome the anchor, the boat is either held fast or subject to the desired slow drift.

Some locations prohibit the use of a conventional drop anchor often due to bottom surface conditions. The bottom can be covered by objects with which the anchor or the anchor line could tangle and which could snare the anchor, anchor line, or both. Once entangled the anchor may be lost.

Another drawback associated with the conventional anchor exists since there are several types of impediments with which the anchor or the anchor line or both could become entangled. Fissures in the bottom, rocks, trees, logs, brush or other obstacles either natural or manmade can result in the loss of the anchor.

Another drawback that is a natural outcome of the loss of an anchor is the danger the boat and its occupants are in once the anchor is lost and foul weather comes up placing the boat and its occupants entirely at the mercy of the elements.

Existing make-shift anchoring devices include using a rope to tie the boat to the nearest available fixed object, for example, a tree projecting above the water or located nearby on shore. Docks can also be used to anchor a boat, however, usually at the end of the day.

These alternatives require the boat to either remain at the dock or to be brought up close enough to the projection to allow the boater to make the knot around the projection or the shoreline. This method could require that the boat be brought perilously close to what would otherwise be considered a navigational hazard.

Further, all boat operators are not sufficiently proficient at tying knots to make a safe and sturdy anchor to the object either sticking out of the water or on shore, a dock or some other stationary object. The rope is then pulled taut by the wind or current acting on the boat, thereby holding the boat in a stationary position.

Accordingly, it is an object of the present invention to provide an improved anchor that is adapted to use in locations in which a conventional anchor is not suggested. With the anchor of this invention it has been found that the use of conventional ropes and anchors is not required in questionable locations, for instance in places where use of a drop anchor is not indicated.

A further object of the present invention is to provide an improved anchor that is constructed to permit uncomplicated attachment to a tree or other stationary object to securely hold a boat or other buoyant vessel in a relatively stationary position.

Still another object of this invention is to provide an anchor that may be readily and easily disconnected from a tree, or other object to which it is attached. The anchor of this invention is preferably operated by hand and includes a bias means that tends to tighten the anchor as anchor line tension is increased.

Still a further object of the present invention is to provide an improved anchor that is adapted for operation from a boat or other buoyant vessel when use of a conventional anchor is not indicated by local conditions.

Another object of the present invention is to provide an anchor that can be used in place of a rope or other line and which is easy to use and operate. The use of the anchor of this invention provides a tree anchor which is economical to produce and use since it should be less prone to loss relative to conventional anchors.

SUMMARY OF THE INVENTION

To accomplish the foregoing and other objects of this invention there is provided an anchor which can be easily attached to and disconnected from a tree or other such object to securely hold a boat or other buoyant vessel in a stationary position down wind or down current from the tree or other such object.

The anchor comprises a hand clamp having two opposite clamp bodies joined near the center with a pivot pin and further having handles on one end and jaws on the other. An internal bias means urges the clamp to a normally closed positioned. In a preferred embodiment a spring intermediate the joined clamp bodies provides the desired bias and urges the jaws together. Tongs extend from the jaws of the clamp body.

The tongs attach to the jaws by a bracket which is in turn pivotally attached to the jaws. The attachment brackets are attached to a shaft intermediate opposing ends of the tongs. In a preferred embodiment the opposing ends are hooked. The non-hooked ends of the tree tongs are pivotally connected by a hinge. An anchor line is attached through a bore defined by a hinge plate. The arrangement of the attachment brackets and hinge creates a design which increases the grasp or holding power of the tongs in direct proportion to the tension on the anchor line.

In operation, the fisherman, or other individual, positions the boat or other buoyant vessel near a tree extending out of the water near the location where he desires to be held stationary and down wind or down current from the tree. The tongs are spread by squeezing together the handles of the clamping device. The now spread apart tongs are positioned relative to the tree with the tree intermediate the tongs.

Releasing the handles allows the bias means to close the tongs either around the tree or into the surface of the tree, thereby causing the points on the hooks engage the tree.

The anchor line attached to the hinge plate will normally be pulled taut and tied to the boat. The boat is now held in place at the end of the anchor line and down wind or down current from the tree. The current and the wind, either independently or together act to increase tension in the anchor line. Increasing the tension increases the grasp or hold of the anchor.

These and other objects and features of the present invention will be better understood and appreciated from the following detailed description or one embodiment thereof, selected for purposes of illustration and shown in the accompanying drawings.

DETAILED DESCRIPTION

Figure 3:
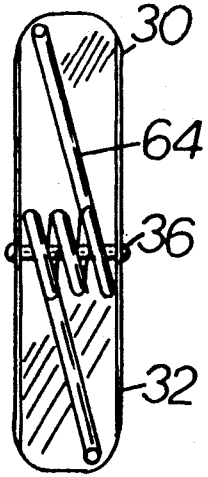
FIG. 3 is an end view of the anchor depicted in FIG. 1.
Figure 1:
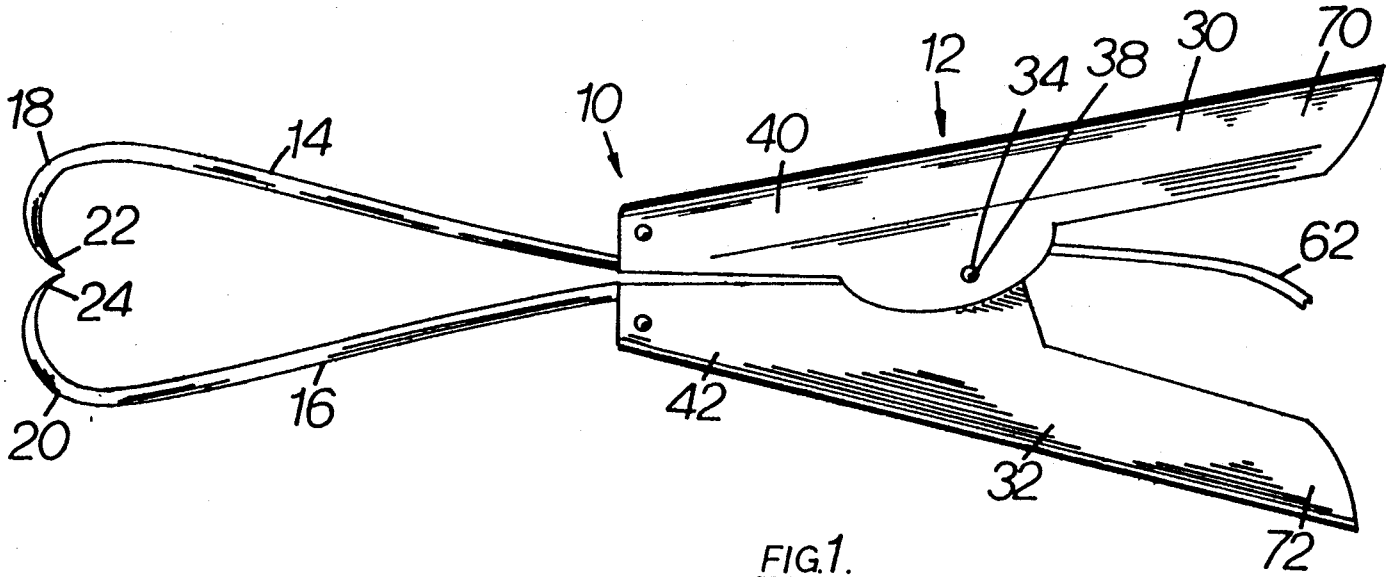
FIG. 1 is a top view of an anchor constructed in accordance with the present invention.
Figure 2:
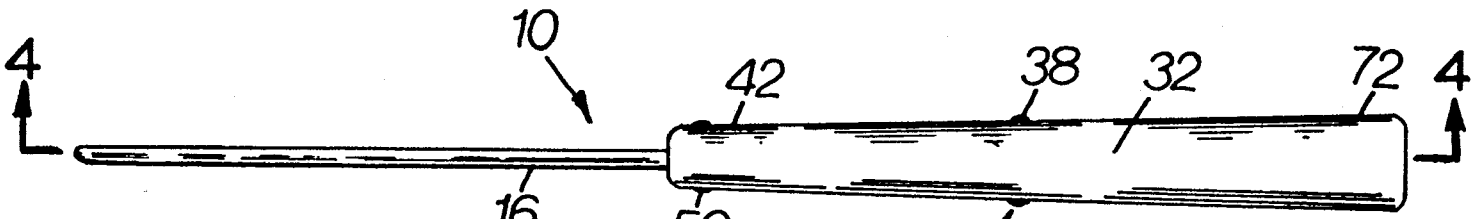
FIG. 2 is a side view of the anchor depicted in FIG. 1.
Figure 4:
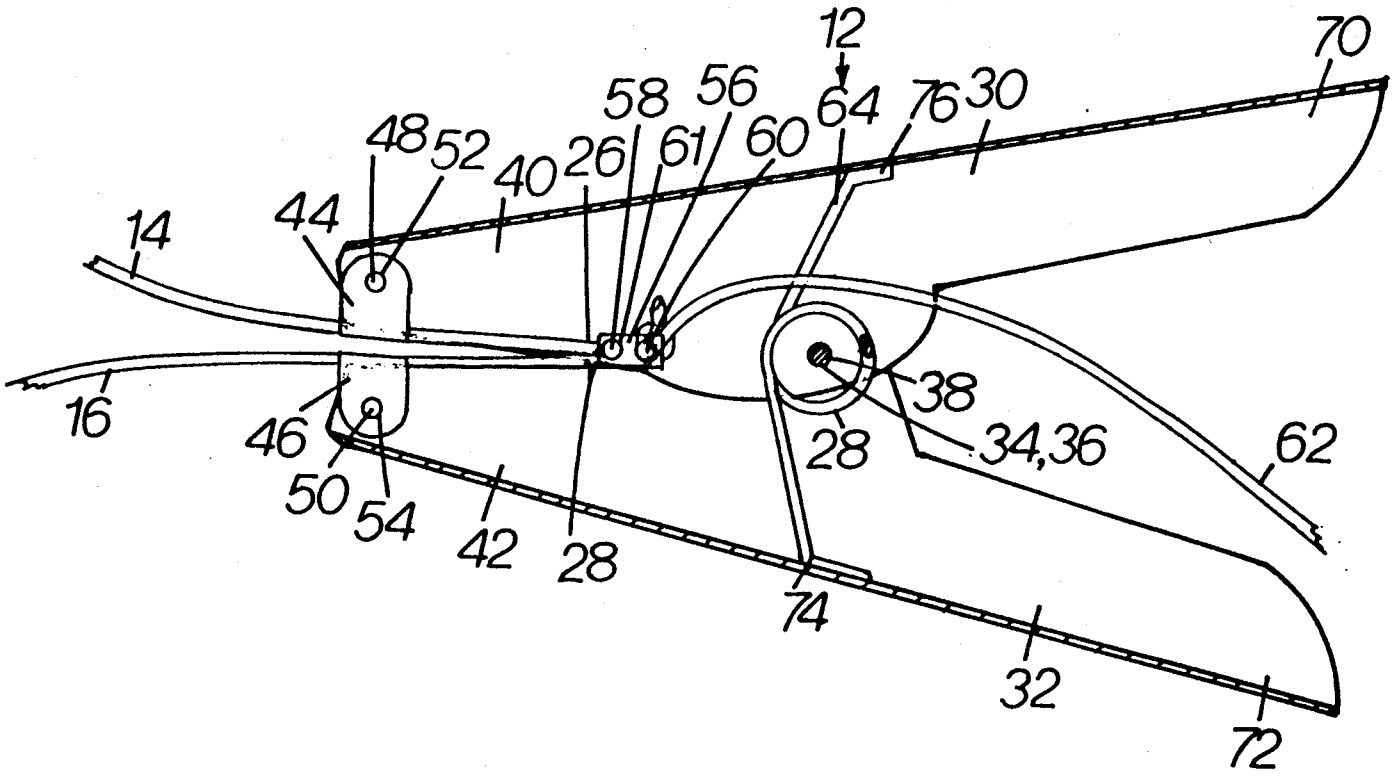
FIG. 4 is a cross-sectional view taken along line 4—4 in FIG. 2.
Figure 5:
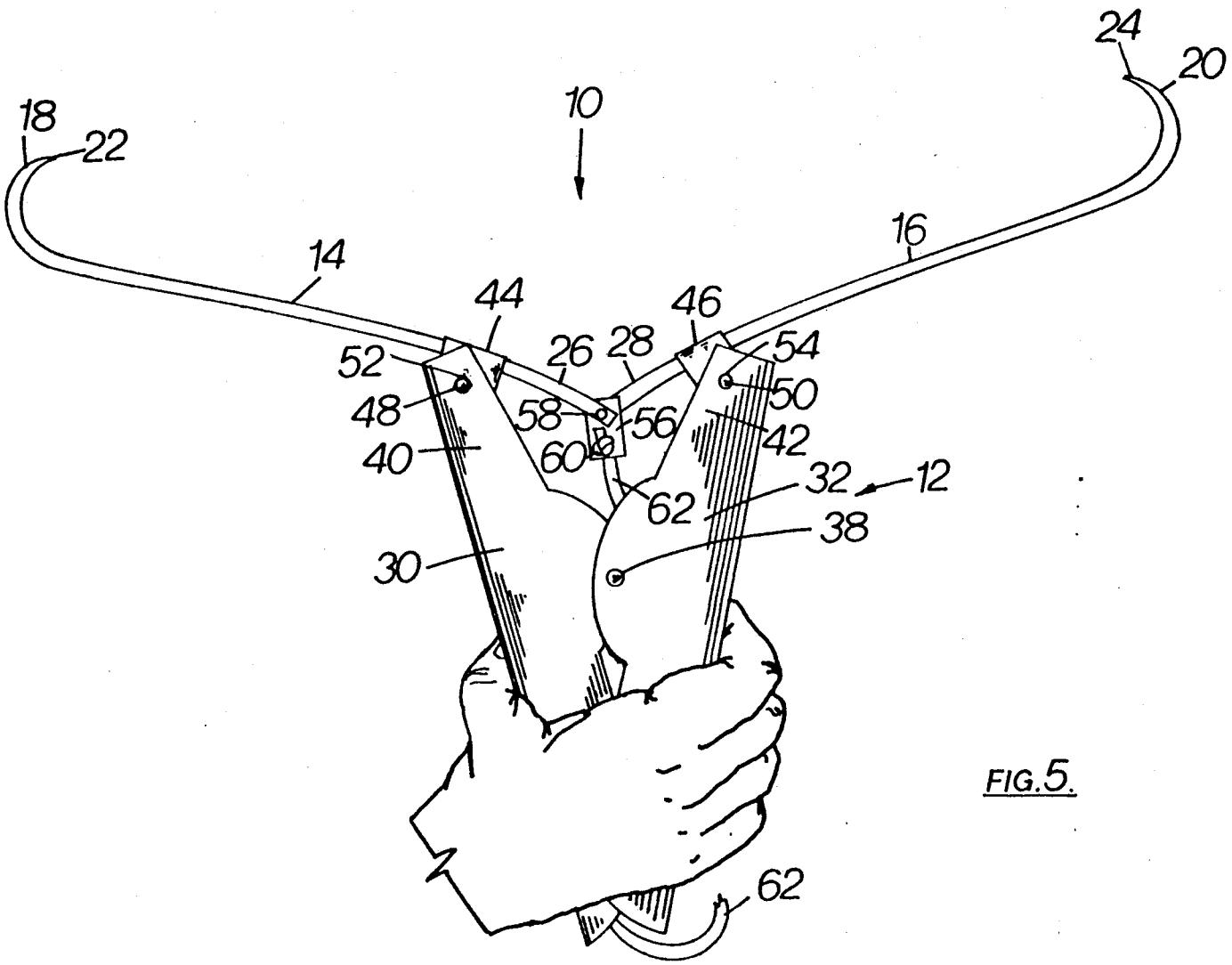
FIG. 5 is another view of the anchor illustrating the tong members of one preferred embodiment in their spaced apart position.

Referring now to the drawings there is shown a preferred embodiment for the anchor of this invention. The anchor is described in connection with anchoring a boat.

The anchor of the present invention is particularly adapted for use as a tree anchor providing an attachment means for a tree or other similar object to anchor a boat and is characterized by a clamping means comprising biased tong members for engaging a tree or other object. In one preferred embodiment the tongs include elongated rod members having hook portions proximate the distal end of the rod and opposite the body section of the clamping device. The hooks may further include points for grasping the surface of the tree or other suitable object.

The drawings show the anchor 10 for use in anchoring a boat 66 or other buoyant vessel to a tree 68, stump or other suitable object. The anchor 10 includes a clamping means which is provided in a preferred embodiment by a clamping device 12 including the tongs members 14 and 16. The tongs extend or project from a pair of jaws 40 and 42. The tongs grasp or engage a tree 68 projecting out of the water.

It will be understood that a tree is used as an example since the tops of submerged trees are often found in man made lakes. These submerged or partially submerged forests formed as the waters rose to form the lake provide an ideal location for the use of the present invention and possibly the worst location for the use of a conventional submerged anchor.

The clamping device 12 includes two clamp bodies 30 and 32 which are mirror images of each other in the preferred embodiment illustrated in the drawings. Each clamp body, 30 and 32, includes a handle section 70 and 72, a pair of jaws 40 and 42, and an intermediate section in which are defined receiving bores for a pivot mechanism. In the illustrated embodiment the intermediate section defines a pair of pivot holes 34 and 36. Each clamp body, 30 and 32, is generally U-shaped as shown in the drawings.

The clamp body members, 30 and 32, join at their respective center sections by means of a pivot pin 38 that extends through the pivot holes 34 and 36. The clamp body members are joined in such a manner that the open portion of the elongated U-shaped bodies face each other.

Bias means are provided to bias each clamp body member toward the other. The bias means attaches to a line securing the anchor 10 such that an increase in line tension provides an increase in the force with which the anchor grasps the tree.

In a preferred embodiment a torsion spring 64 is located intermediate the two clamp bodies, 30 and 32. The torsion spring 64 is located intermediate the center sections and held in place with the pivot pin 38.

In the illustrated embodiment the torsion spring 64 includes two spring ends 74 and 76 and a center spring coil 78. The pivot pin 38 extends through the center of the spring coil 78 to hold the torsion spring 64 in place. The spring ends 74 and 76 generally extend from the spring coil 78 and contact the inside of the clamp bodies, 30 and 32, respectively. In this manner the bias means provides the bias to compel the jaws 40 and 42 together.

The clamp jaws 40 and 42 are spread by squeezing the handles 70 and 72 together. As will be seen in the drawings squeezing the handles causes the clamp bodies 30 and 32 to pivot about pivot pin 38.

The tongs 14 and 16 are received by jaws 40 and 42. The tongs 14 and 16 are preferably elongated rod members, each defining an end hook, 18 and 20, respectively. The opposite tong ends each define a lateral bore, 26 and 28, respectively. These bores extend generally through each rod member. In a preferred embodiment each hook, 18 and 20, includes a point, 22 and 24, respectively. The points are located at the distal ends of each tong and provide for an increased purchase of the anchor with respect to the tree to which it is attached.

It now will be understood that as the tongs tighten into the surface of the tree the hooks enter the tree farther to provide a stronger grasp of the tree as the anchor line exerts a stronger tension on the anchor.

The tong members 14 and 16 are preferably joined by a hinge point 58 through the lateral bores 26 and 28. A hinge plate 56 is positioned intermediate the joined tongs 14 and 16.

In a preferred embodiment the hinge plate 56 is a rectangular member having a first bore 60 therethrough for receiving an anchor line 62 and a second bore 61 for receiving the hinge pin 58. The hinge pin 58 extends through the bore 26 on the tong 14, through the second bore 61 on the hinge plate 56, and through bore 28 on the tong 16. In this manner the tongs 14 and 16 are joined with the hinge plate 56 located intermediate the tong members.

It will be understood that the foregoing pivot means can be constructed with other constructions and assemblies and that for purposes of clarity only the preferred embodiment has been described in detail.

The tongs 14 and 16 attach to the inside of jaws 40 and 42 preferably by means of respective attachment brackets 44 and 46. The attachment brackets are attached so as to pivot at the inside of jaws 40 and 42.

The desired pivot is accomplished by means of bracket pins 48 and 50. The bracket pins 48 and 50 extend through a bracket pin hole 52 defined in the U-shaped jaw assembly 40 and 42. The bracket pins 48 and 50 further extend through a bore defined in the attachment brackets 44 and 46 and through another bracket pin hole 54 defined in the other side of the U-shaped jaw assembly 40 and 42. In this manner the attachment brackets 44 and 46 are allowed to pivot about the bracket pins 48 and 50 within the jaws 41 and 42.

In the preferred embodiment described and shown the attachment brackets 44 and 46 attach to the tongs 14 and 16 at a location intermediate the respective hook ends, 18 and 20, and the bores 26 and 28.

Bracket location is generally determined by the desired size and spread of the tongs 14 and 16 and the size of the clamp 12. Bracket location is preferably at a location on the rod member such that when the clamp 12 is in a closed position (jaws 40 and 42 are together and points 22 and 24 are touching or near touching) the end of hinge plate 56 defining the first bore 60 is located proximate the spring coil 78 or pivot pin 38.

An anchor line 62 attaches to the anchor 10 through the first bore 60 defined by the hinge plate 56. The anchor line extends proximate spring coil 78 and pivot pin 38 and intermediate the handles 70 and 72. The anchor line is attached to the boat 66.

In operation, in connection with the embodiment and application previously mentioned to generally maintain a desired boat position relative to the anchor 10, a desired anchorage is located and the anchor 10 is attached to the tree 68.

The handles 70 and 72 are squeezed together causing the jaws 40 and 42 to open. The tong hooks 18 and 20 separate. The now separated tong hooks are placed around the tree 68. Releasing the handles 70 and 72 allows the bias means to urge the tong hooks towards one another. This action engages the hooks 18 and 20 with tree 68.

Figure 6:
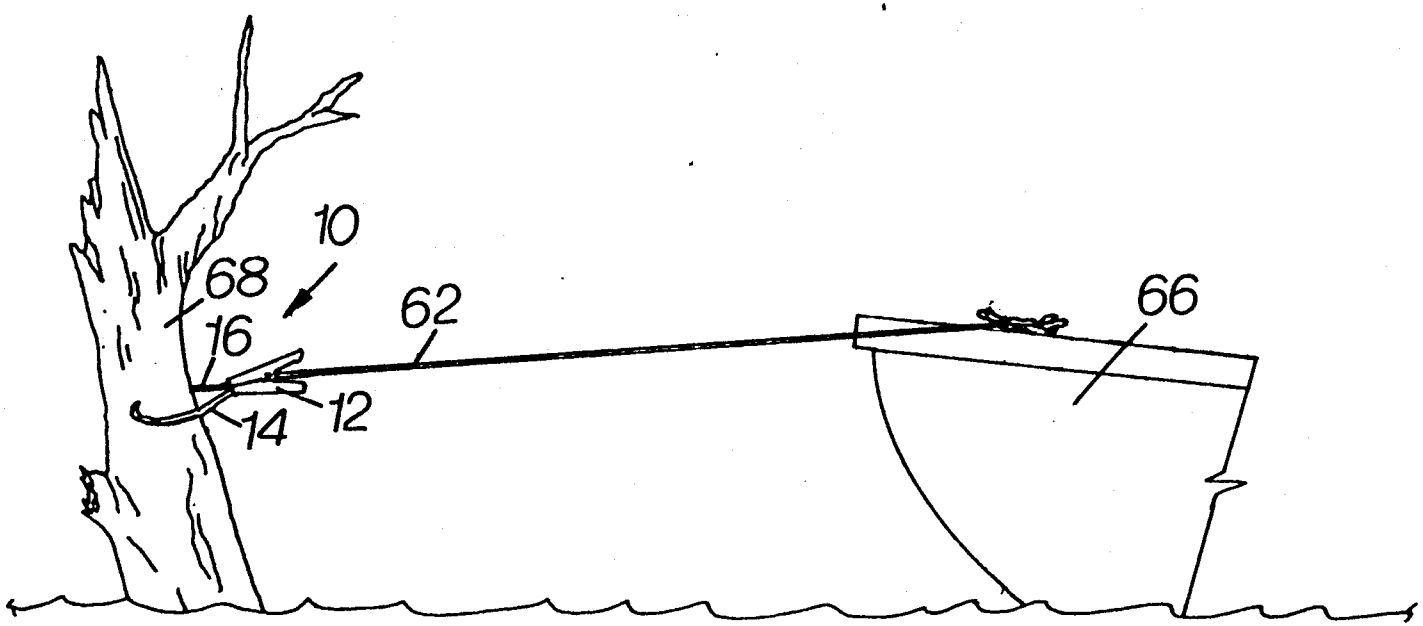
FIG. 6 is an illustration showing the tree anchor in use.

The free end of the anchor line 62 is tied to the boat 66. The slack in the line is taken up directly or through the use of a conventional cleat. Now the boat 66 or other buoyant vessel is maintained a relatively stationary position and generally down wind or down current from the tree. This is illustrated in FIG. 6.

As the wind, current or other force acts on boat 66 the tension in the anchor line 62 increases in direct proportion to the force. The increased tension on anchor line 62 is transmitted to the hinge plate 56 to which the anchor line 62 is attached. This increased tension results in an increase in the grasp of the anchor and the force transmitted through the tong members and the points 22 and 24. The holding power of the tree anchor 10 increases in direct proportion to the increased anchor line tension.

In a preferred embodiment the grasp of the anchor 10 increases as a result of the attachment of the brackets 46 and 48 to the tong members 14 and 16 intermediate the hooks 18 and 20 and the bores 26 and 28. The increased grip or hold further results from the described pivoting attachment of the brackets 46 and 48 relative to the jaws 40 and 42. It will be further understood that joining and pivoting of the tongs 14 and 16 at the hinge plate 56 intermediate the jaws 46 and 48 and spring coil 78 transfers an increase in tension to the hinge plate.

From the foregoing description those skilled in the art will appreciate that all of the objects of the present invention are realized. An anchor 10 is provided which can be used as an anchor to anchor a boat or buoyant vessel device to a tree or the like has been provided. The improved anchor of the present invention is adapted for use in locations in which a conventional anchor is not suggested.

The anchor of this invention renders unnecessary the use of conventional ropes and, particularly in questionable locations, for instance in places where use of a drop anchor is not indicated due for example to the danger of losing the conventional anchor. The construction of the improved anchor of this invention permits uncomplicated attachment to a tree or other stationary object to securely hold a boat or other buoyant vessel in a relatively stationary position by clamping opposing tongs to the object.

Further, it is now apparent that the anchor of the present invention is readily and easily disconnected from a tree, or other object to which it is attached. The hand operated anchor of this invention utilizes a bias means to tighten the anchor as the tension of an associated anchor line is increased.

Where a bottom anchor could be lost in submerged debris or bottom snags, the present invention provides an improved anchor that is adapted for operation from a boat or other buoyant vessel with objects at, near, or above the water line and is less likely to be lost. In most instances, if the boat can be brought alongside the tree, then the anchor of the present invention can be retrieved.

While a specific embodiment has been shown and described, many variations are possible. The particular shape of the anchor, the handles, tongs, and hooks, the type of bias means used and the various components described above may be changed as desired to suit the equipment with which it is used. The anchor materials may vary although a light weight yet strong metal such as aluminum is preferred.

The handle, tong and other components may vary although the preferred embodiment shows the opposed handles and internal bias means. The particular type of clamping member, shape of the tree tongs, and means of attaching the tongs to the clamp may vary, be changed or altered to suit a particular application, design or use.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of this invention be determined by the appended claims and their equivalents.

What is claimed is:

1. An anchor for maintaining a buoyant vessel in a relatively stable position, comprising:

means for clamping an anchor to an object;

means for connecting the clamping means to a buoyant vessel, the buoyant vessel to be maintained in a relatively stable position by the tension of the connecting means between the clamping means and the buoyant vessel; and means for tightening the clamping means as connecting means tension increases.

2. An anchor as set forth in claim 1 wherein the clamping means includes in combination:

a clamping device; and a plurality of object grasping members that respond to the tightening means by an increase in the force with which the object is grasped.

3. An anchor as set forth in claim 2 wherein the object grasping members include a pair of tongs mounted in and extending outward from the clamping device.

4. An anchor as set forth in claim 3 wherein each tong includes a hook.

5. An anchor as set forth in claim 1 wherein means for tightening the clamping means as connecting means tension increases includes a bias means responding to the connecting means tension.

6. An anchor means as set forth in claim 5 wherein the bias means comprise a torsion spring contained within clamping means.

7. An anchor as set forth in 1 wherein the clamping means comprise opposing clamping body members.

8. An anchor as set forth in claim 7 wherein the clamping means further comprises:

opposing clamping members each the mirror image of the other, the clamping bodies having a handle section, center section and jaw section, and the clamping bodies pivotally joined at the center sections by a pivot pin; and attachment brackets pivotally attached to the inside of the jaw sections to receive and mount the tongs.

9. An anchor as set forth in claim 8 wherein means for tightening the clamping means as connecting means tension increases includes a bias means responding to the connecting means tension.

10. An anchor as set forth in claim 9 wherein the bias means comprise a torsion spring contained within the joined clamping bodies to provide bias to the jaw sections.

11. An anchor for maintaining a buoyant vessel in a relatively stable position, comprising:

a clamping device;

a pair of tongs mounted in and extending outward from the clamping device, the tongs having hooks on an end of the tongs extending from the clamping device, and an anchor line attached to the anchor for attachment to a buoyant vessel.

12. An anchor as set forth in claim 11 in which the clamping device comprises:

two clamping bodies, each the mirror image of the other, the clamping bodies having a handle section, center section and jaw section, the clamping bodies pivotally joined at the center sections by a pivot pin;

a torsion spring contained within the joined clamping bodies to provide bias to the jaw sections; and attachment brackets pivotally attached to the inside of the jaw sections to receive and mount the tongs.

13. An anchor as set forth in claim 11 in which the tongs comprise:

a plurality of rod members, the rod members each having a hook at one end, the hook further having a point, and an end containing a lateral bore, the rod members joined by a hinge pin through the lateral bores.

14. An anchor as set forth in claim 11 in which the anchor further comprises attachment brackets, the tongs being attached to the clamping device by the attachment brackets, the attachment brackets being attached to the tongs at a position between the hook and the lateral bore and the attachment brackets being pivotally attached in the clamping device.

15. An anchor as set forth in claim 13 further comprising a hinge plate pivotally attached between the tongs by the hinge pin.

16. An anchor as set forth in claim 11 in which the buoyant vessel comprises a boat.

17. An anchor comprising:

a clamping device, the clamping device comprising two clamping bodies, each the mirror image of the other, the clamping bodies having a handle section, center section and jaw section, the clamping bodies pivotally joined at the center sections by a pivot pin;

a torsion spring contained within the joined clamping bodies to provide bias to the jaw sections;

tongs, the tongs comprising, a plurality of rod members, the rod members each having a hook at one end, the hook further having a point, and an end containing a lateral bore, the rod members joined by a hinge pin through the lateral bores;

attachment brackets pivotally attached to the inside of the jaw sections to receive and mount the tongs to the clamping device, the attachment brackets being attached to the tongs at a position between the hook and the lateral bore;

a hinge plate pivotally attached between the tongs by the hinge pin; and an anchor line, the anchor line being attached to the hinge plate.

18. A method of anchoring a buoyant vessel in a relatively stationary position down wind or down current from a tree, stump or other stationary object comprising:

positioning the buoyant vessel near a tree, stump or other stationary object near the desired location on a body of water;

spreading a clamping device, thereby spreading tong attached to the clamping device;

positioning the spread tongs around the tree or other stationary object;

engaging the tongs onto the tree or other stationary object by closing the clamping device;

attaching an anchor line extending from the tong contained on the clamping device to the buoyant vessel; and tightening the grip of the tongs by increasing tension on the anchor line.

* * * * *